US007717021B2

(12) United States Patent
Erlenmaier

(10) Patent No.: US 7,717,021 B2
(45) Date of Patent: May 18, 2010

(54) PUNCH TOOL LIFT SPINDLE

(75) Inventor: Werner Erlenmaier, Gerlingen (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 0 days.

(21) Appl. No.: 11/563,582

(22) Filed: Nov. 27, 2006

(65) Prior Publication Data

US 2007/0240551 A1 Oct. 18, 2007

Related U.S. Application Data

(63) Continuation of application No. PCT/EP2005/005636, filed on May 25, 2005.

(30) Foreign Application Priority Data

May 27, 2004 (EP) ..... 04012523

(51) Int. Cl.
*B26D 5/08* (2006.01)
*B23C 7/00* (2006.01)

(52) U.S. Cl. ..... 83/523; 83/594; 83/698.91; 83/686; 483/56

(58) Field of Classification Search ..... 83/523, 83/597, 698.91, 686, 555; 219/121.72; 483/56, 483/31

See application file for complete search history.

(56) References Cited

U.S. PATENT DOCUMENTS

| | | | | |
|---|---|---|---|---|
| 1,533,236 | A * | 4/1925 | Dawson | 148/566 |
| 6,280,124 | B1 * | 8/2001 | Ammann | 408/129 |
| 7,112,019 | B2 * | 9/2006 | Ammann | 409/231 |
| 2002/0045521 | A1 * | 4/2002 | Mochida et al. | 483/31 |
| 2006/0144831 | A1 * | 7/2006 | Schmidt et al. | 219/121.72 |
| 2007/0101840 | A1 * | 5/2007 | Schmauder | 83/13 |

FOREIGN PATENT DOCUMENTS

| | | |
|---|---|---|
| JP | 04-172133 | 6/1992 |
| JP | 11-207560 | 8/1999 |

OTHER PUBLICATIONS

International Preliminary Report on Patentability from corresponding application No. PCT/EP2005/005636, mailed Nov. 29, 2006.

* cited by examiner

*Primary Examiner*—Ghassem Alie
(74) *Attorney, Agent, or Firm*—Fish & Richardson P.C.

(57) ABSTRACT

In one embodiment, a punching machine having a tool bearing, a drive spindle coupled to the tool bearing, and a drive system configured to move the tool bearing axially along a lifting axis and to rotate the tool bearing about the lifting axis, the drive system having a motor system having a stator and a rotor internally coupled to the stator and a spindle nut coupled to the rotor and cooperating with the drive spindle, wherein the spindle nut is at is at least partially disposed within the stator.

15 Claims, 6 Drawing Sheets

PUNCH TOOL LIFT SPINDLE

CROSS REFERENCE TO RELATED APPLICATIONS

This application is a continuation of, and claims priority under 35 U.S.C. §120 to PCT/EP2005/005636, filed on May 25, 2005, and claims priority under 35 U.S.C. §119 from European application EP 04 012 523.9, filed May 27, 2004. Both of these references are hereby incorporated by reference.

TECHNICAL FIELD

This invention relates to industrial equipment, and more particularly to machines configured to cut or punch workpieces, such as metal sheets.

BACKGROUND

As those of ordinary skill in the art will appreciate, punching machines may be employed to punch holes or other cutouts from a workpiece (e.g., a metal sheet). Typically, punching machines include a tool bearing for a punching tool and a rotary/lifting drive, which moves the tool bearing back and forth along a lifting axis to a working area of the punching machine. Also, the tool bearing is rotatably adjustable about the lifting axis. The punching machine may also include a motor-driven spindle transmission provided with a drive control system. Typically, a rotary/lifting drive having two electric drive motors is provided for the tool bearing of a punching machine. Both drive motors may be arranged laterally next to a drive spindle, which in turn runs in the direction of a lifting axis of the tool bearing. One of the drive motors serves for workpiece punching and for that purpose is connected via a belt drive to a lifting spindle nut disposed on the drive spindle. By driving this spindle transmission in one direction of rotation, the tool bearing (and hence the attached punching tool) is moved with working strokes towards the workpiece to be processed and then by reversing the motor, the tool bearing is moved in the opposite direction. The second drive motor in a conventional punching machine is intended for rotary adjustment of the tool bearing and the punching tool. This drive motor is connected via another belt drive to enable rotation of the punching tool relative to the lifting axis. A more efficient punching tool would be desirable.

SUMMARY

In one embodiment, the spindle transmission for stroke movement of the tool bearing in the radial direction lies inside the stator of the lifting drive motor. Additionally or alternatively, the driving element for rotary adjustment of the tool bearing is arranged radially inside the stator of the rotary drive motor. In the radial direction of the drive spindle the rotary/lifting drive according to the invention is consequently comparatively small. The resulting dimensions of the rotary/lifting drive in the axial direction of the drive spindle may also be relatively small.

In another possible embodiment, a compact construction of the complete machine may be achieved by minimizing the number of drive motors needed for the stroke movement and the rotary adjustment of the tool bearing. In this embodiment, a single rotary/lifting drive motor is provided, which serves both for movement of the tool bearing in the direction of the lifting axis and for rotary adjustment of the tool bearing about the lifting axis. This dual function of the rotary/lifting drive motor is facilitated by a controllable switching arrangement. This arrangement allows a driving element for the drive spindle to be connected to the rotary/lifting drive motor or to be disconnected from the rotary/lifting drive motor. In the one case, the rotary/lifting drive motor drives the driving element including the drive spindle about the spindle axis, which causes a rotary adjustment of the tool bearing about the lifting axis. If the driving element for the drive spindle and the rotary/lifting drive motor are disconnected from one another in respect of drive, then the rotary/lifting drive motor drives merely the lifting spindle nut. This results in the drive spindle being displaced in the direction of the spindle axis causing the tool bearing to be moved in the direction of the lifting axis.

Further, in some other possible embodiments, the rotary movement of the drive spindle is accompanied by a corresponding rotary movement of the lifting spindle nut disposed on the drive spindle. As such, rotary adjustment of the tool bearing can be performed without a relative rotary movement of the lifting spindle nut and drive spindle to avoid a movement of the tool bearing along the lifting axis.

In still another possible embodiment, there is provided a coupling slide between the motor-side lifting spindle nut and the driving element for the drive spindle to facilitate the connection or disconnection of the rotary/lifting drive motor and the driving element for the drive spindle. For example, in one embodiment, a force-fit connection may be employed. In another embodiment, an interlocking connection may be employed.

In yet another embodiment a rotation prevention system is provided for the drive spindle. More specifically, on disconnection of the driving element from the rotary/lifting drive motor, the rotation prevention system prevents rotation of the drive spindle about the spindle axis. The drive connection of the lifting spindle nut and rotary/lifting drive motor consequently affects an exclusively axial movement of the drive spindle, and, hence, a lifting movement of the tool bearing without associated rotary adjustment movement. For example, in one embodiment, the rotation prevention system of the drive spindle may include an anti-rotation slide that can be either fixed against rotation about the spindle axis or can be released for such a rotation.

In still another possible embodiment, a coupling/anti-rotation slide undertakes both the connection or disconnection in respect of drive of the rotary/lifting drive motor and the driving element for the drive spindle, as well as the establishment or termination of rotary protection of the drive spindle. In still another embodiment, a torque motor may be employed as either the lifting drive motor and/or the rotary drive motor. As will be appreciated, this type of motor enables even high torques to be transferred without interposed gearing as such embodiments employing a torque motor may be compact.

In yet another embodiment, there is provided, a punching machine including a tool bearing, a drive spindle coupled to the tool bearing, and a drive system configured to move the tool bearing axially along a lifting axis and to rotate the tool bearing about the lifting axis, the drive system including a motor system comprising a stator and a rotor internally coupled to the stator and a spindle nut coupled to the rotor and cooperating with the drive spindle, wherein the spindle nut is at least partially disposed within the stator.

In still another configuration, there is provided a punching machine including a tool bearing, a drive system configured to move the tool bearing axially along a lifting axis and to rotate the tool bearing about the lifting axis, the drive system including a motor system comprising a stator and a rotor internally coupled to the stator and a drive element coupled to the rotor and configured to transmit rotary movement from the rotor to the tool bearing, wherein the torque drive element is at least partially disposed within the stator.

In still another configuration, there is provided a punching machine including a tool bearing, a drive system configured to move the tool bearing axially along a lifting axis and to rotate the tool bearing about the lifting axis, the drive system including a motor comprising a first stator and a first rotor internally coupled to the first stator and a driving element engageable with the motor, wherein the driving element is configured to prevent rotation of the tool bearing about the lifting axis when the driving element is disengaged with the motor, such that the tool bearing is configured to move axially along the lifting axis without rotation when the driving element is disengaged with the motor, and wherein the driving element is configured to rotate the tool bearing about the lifting axis when the driving element is engaged with the motor.

DESCRIPTION OF DRAWINGS

The details of one or more embodiments of the invention are set forth in the accompanying drawings and the description below. Other features, objects, and advantages of the invention will be apparent from the description and drawings, and from the claims.

Like reference symbols in the various drawings indicate like elements.

DETAILED DESCRIPTION

Figure 1:
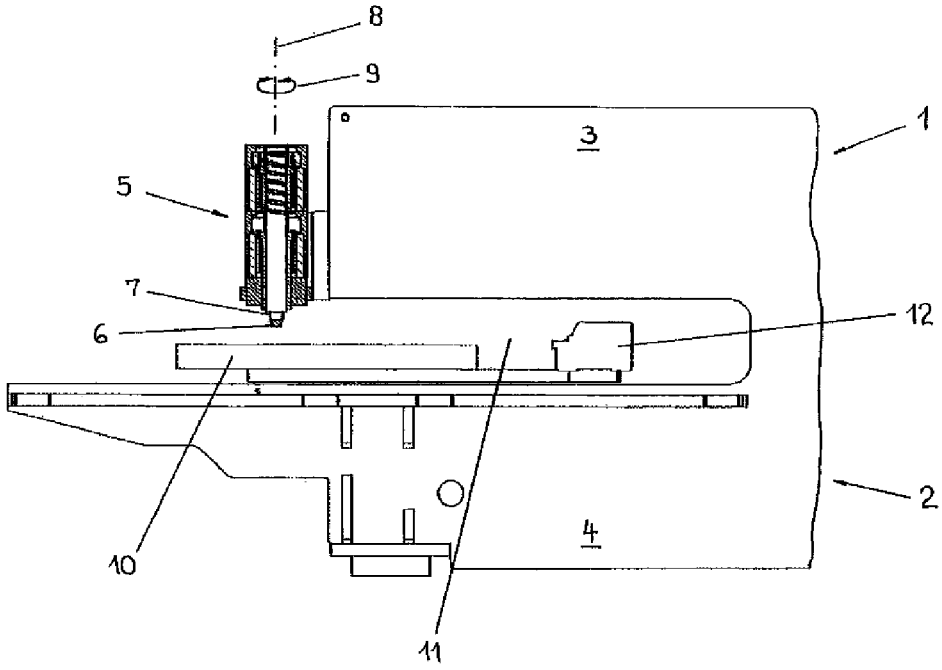
FIG. 1 shows a partial sectional side-view of a punching machine having a first construction of an electric rotary/lifting drive for a punch upper die.

As shown in FIG. 1, a punching machine 1 has a C-shaped machine frame 2 with an upper frame member 3 and a lower frame member 4. An electric rotary/lifting drive 5 for a punching tool in the form of a punch 6 and for a tool bearing 7 equipped with the punch 6, is mounted at the free end of the upper frame member 3. By means of the rotary/lifting drive 5, the tool bearing 7 is movable in a straight line jointly with the punch 6 in the direction of a lifting axis 8 and is adjustable by rotation in the direction of a double arrow 9 about the lifting axis 8. Movements in the direction of the lifting axis 8 may be performed by the tool bearing 7 and the punch 6 during the working strokes for processing workpieces and during return strokes following the working strokes. Rotary adjustment of the tool bearing 7 and the punch 6 is performed to change the rotated position of the punch 6 relative to the lifting axis 8.

When machining a workpiece, (e.g., when punching sheets), the punch 6 cooperates with a punching lower tool (not shown) in the form of a die. In one embodiment, the punching lower tool may be integrated into a workpiece table 10, which in its turn mounted on the lower frame member 4 of the punching machine 1. The relative movements of the sheet that are required during machining of the workpiece relative to the punch 6 and the die are performed by a coordinate guide 12 housed in a gap area 11 of the machine frame 2.

As can be inferred in detail from FIGS. 2 to 5, the rotary/lifting drive 5 may include a drive housing 13 that has an electric rotary/lifting drive motor 14 of which the direction of rotation may be reversible. In one embodiment, the rotary/lifting drive motor 14 is a torque motor with a stator 15 fixed to the housing and with a rotor 16 rotating inside the stator 15 about the lifting axis 8. The rotor 16 of the rotary/lifting drive motor 14 may be directly and hence gearlessly connected to a lifting spindle nut 17, which sits on a drive spindle 18.

Figure 5:
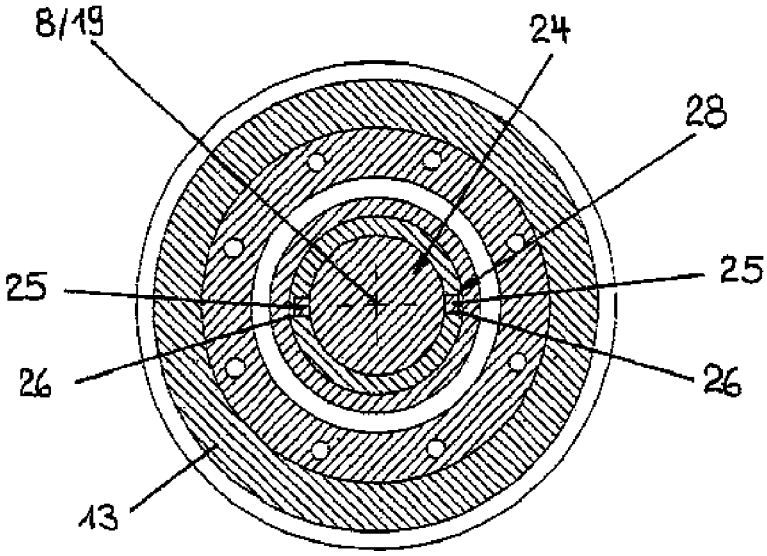
FIG. 5 shows a cross-sectional view of a section plane from FIG. 2 perpendicular to the drawing plane and along the line V-V.

A spindle axis 19 of the drive spindle 18 may coincide with the lifting axis 8. In the axial direction, the lifting spindle nut 17 and the stator 15 of the rotary/lifting drive motor 14 are arranged mutually overlapping with its axial end facing towards the tool bearing 7. The lifting spindle nut 17 has a flange 20 at its axial end facing towards the tool bearing 7. A rolling-contact bearing 21 may be provided for rotary mounting of the lifting spindle nut 17 on the drive housing 13. By means of a first sensor arrangement 22 the direction of rotation and the angle of rotation of the lifting spindle nut 17 rotating about the lifting axis 8 (i.e. the spindle axis 19) may be detected. Jointly with the drive spindle 18, the lifting spindle nut 17 forms a spindle transmission 23, which in the embodiment illustrated is constructed as a ball screw transmission. Adjoining the drive spindle 18 towards the tool bearing 7, there is an axial extension 24 that is integral with the drive spindle 18. The axial extension 24 may be a circular cylindrical body from which radial fins 25 may project for part of the length of the axial extension 24. The radial fins 25 may have a substantially rectangular cross-section, as shown in FIG. 5 and may be received in axial guide grooves 26 of a driving element 27.

The driving element 27 surrounds the axial extension 24 and the drive spindle 18 concentrically. Its axial guide grooves 26 form, in cooperation with the radial fins 25 of the axial extension 24, an axial guide 28 for the axial extension 24 and the drive spindle 18 constructed in one piece therewith. A rolling-contact bearing 29 may be responsible for the rotary mounting of the driving element 27 and the axial extension 24 and the drive spindle 18 on the drive housing 13. A second sensor arrangement 30 serves to detect the rotated position of the axial extension 24 and of the tool bearing 7 provided thereon and of the punch 6 relative to the lifting axis 8.

The driving element 27 can either be connected in respect of drive to the rotary/lifting drive motor 14 or can be disconnected in respect of drive from the rotary/lifting drive motor 14 by means of a controllable switching arrangement 31. For that purpose, the controllable switching arrangement 31 may include a coupling/anti-rotation, slide 32, which is slidably guided in the axial direction on the outside of the driving element 27. Around the lifting axis 8, the coupling/anti-rotation slide 32 is supported on the driving element 27 secured against rotation by splines. A plurality of actuating slides 33, which are movably guided on the drive housing 13 in the direction of the lifting axis 8 and have a common pneumatic drive, serves for axial displacement of the coupling/anti-rotation slide 32.

The coupling/anti-rotation slide 32 engages with the free end of a flange 34 in the actuating slides 33. A radial flange face 35 of the flange 34 on the coupling/anti-rotation slide 32 lies opposite a radial flange face 36 on the flange 20 of the lifting spindle nut 17. On its side opposite from the radial flange face 35, the flange 34 of the coupling/anti-rotation slide 32 is provided with a further radial flange face 37, which is associated with a bearing surface 38 on the drive housing 13.

Figure 2:
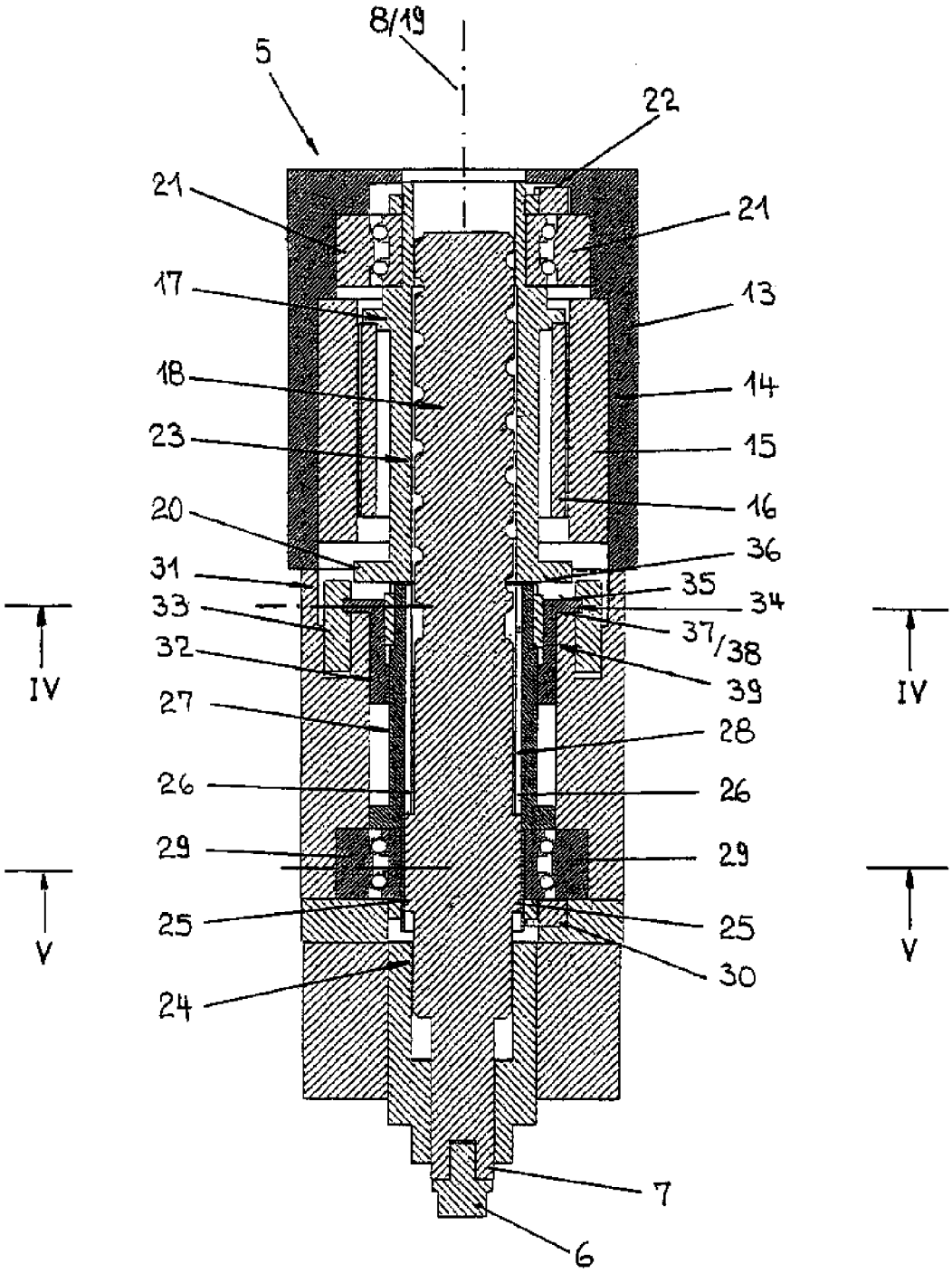
FIG. 2 shows the rotary/lifting drive of FIG. 1 in a first operating state.

FIG. 2 shows the electric rotary/lifting drive 5 in the operating state associated with workpiece punching. Accordingly, the lifting spindle nut 17 mounted rotatably and axially fixed on the drive housing 13 is rotated in the direction of rotation concerned about the lifting axis 8, i.e. the spindle axis 19. The coupling/anti-rotation slide 32 of the controllable switching arrangement 31 is then displaced into its lower final position by means of the actuating slides 33. The driving element 27 is consequently disconnected in respect of drive from the rotary/lifting drive motor 14.

Further, during operation, the radial flange face 37 on the coupling/anti-rotation slide 32 is supported on the bearing surface 38 of the drive housing 13. By virtue of the normal force acting on the radial flange face 37 of the coupling/anti-rotation slide 32 and the bearing surface 38 of the drive housing 13, the coupling/anti-rotation slide 32 is fixed on the drive housing 13 against rotation about the lifting axis 8. By means of the coupling/anti-rotation slide 32, the driving element 27 and the axial extension 24 supported thereon locked against rotation and the drive spindle 18 is constructed in one piece with the extension 24 secured against rotation about the lifting axis 8. Accordingly, the coupling/anti-rotation slide 32 in cooperation with the driving element 27 and the drive housing 13 forms a rotation preventing system 39 for the drive spindle 18 with the drive housing 13 serving as an abutment for the driving element.

The rotation prevention system 39 prevents the drive spindle 18 from being carried with the lifting spindle nut 17 rotating about the lifting axis 8. Owing to the rotation of the lifting spindle nut 17 relative to the drive spindle 18, the drive spindle 18 is displaced in the direction of the lifting axis 8 jointly with the axial extension 24. The tool bearing 7 provided thereon and the punch 6 is held in the tool bearing 7. Depending on the direction of rotation of the lifting spindle nut 17, the tool bearing 7 and the punch 6 are lowered with a working stroke towards the workpiece to be machined or alternatively following a working stroke are retracted with respect to the workpiece with a reverse stroke.

Figure 3:
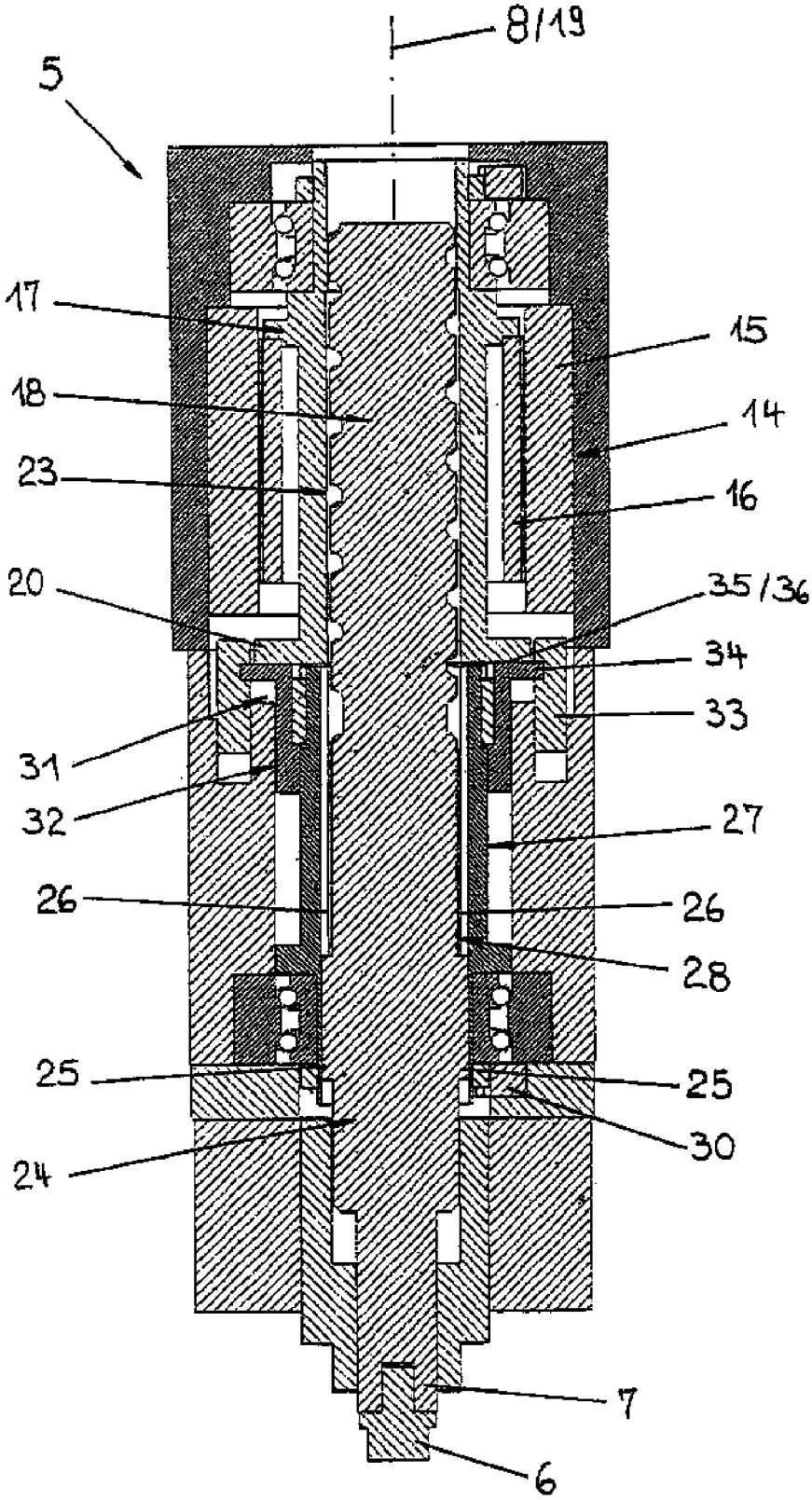
FIG. 3 shows the rotary/lifting drive of FIGS. 1 and 2 in a second operating state.
Figure 4:
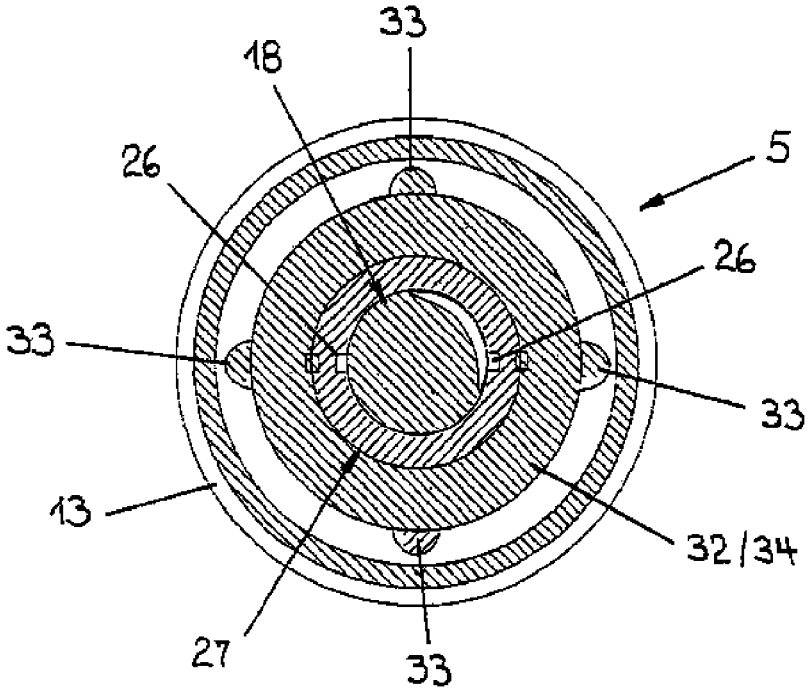
FIG. 4 shows a cross-sectional view of a section plane from FIG. 2 running perpendicular to the drawing plane and along the line IV-IV.

FIG. 3 illustrates the embodiment of FIG. 2 when the rotated position of the tool bearing 7 and the punch 6 relative to the lifting axis 8 is to be changed. In this case, the driving element 27 and the rotary/lifting drive motor 14 are connected to one another in respect of drive by way of the coupling/anti-rotation slide 32 of the controllable switching arrangement 31. For that purpose, the coupling/anti-rotation slide 32 is displaced by means of the actuating slides 33 into an axial position. When it has assumed that position, it is pressed with its radial flange face 35 onto the radial flange face 36 of the lifting spindle nut 17. A force-fit connection is consequently produced between the lifting spindle nut 17 and the coupling/anti-rotation slide 32. By virtue of this force-fit connection, the coupling/anti-rotation slide 32, the driving element 27 as well as the axial extension 24, and the drive spindle 18 move jointly with the lifting spindle nut 17 in the direction of rotation thereof. In the process, there is no relative rotary movement between lifting spindle nut 17 and drive spindle 18. The drive spindle 18, the axial extension 24 and the tool bearing 7 with punch 6 provided thereon perform exclusively a rotary movement about the lifting axis 8.

In one embodiment, all the functions of the electric rotary/lifting drive 5 are numerically controlled. For example, the first sensor arrangement 22 and the second sensor arrangement 30 may be part of the numeric control system. The first sensor arrangement 22 may serve here for controlled execution of the working strokes and the reverse strokes of the punch 6 in the direction of the lifting axis 8. The second sensor arrangement 30 may serves for control of the rotary adjustment of the punch 6 about the lifting axis 8. In one embodiment, the rotary adjustment of the punch 6 encompasses a corresponding rotary adjustment of the die co-operating with the punch 6.

Figure 6:
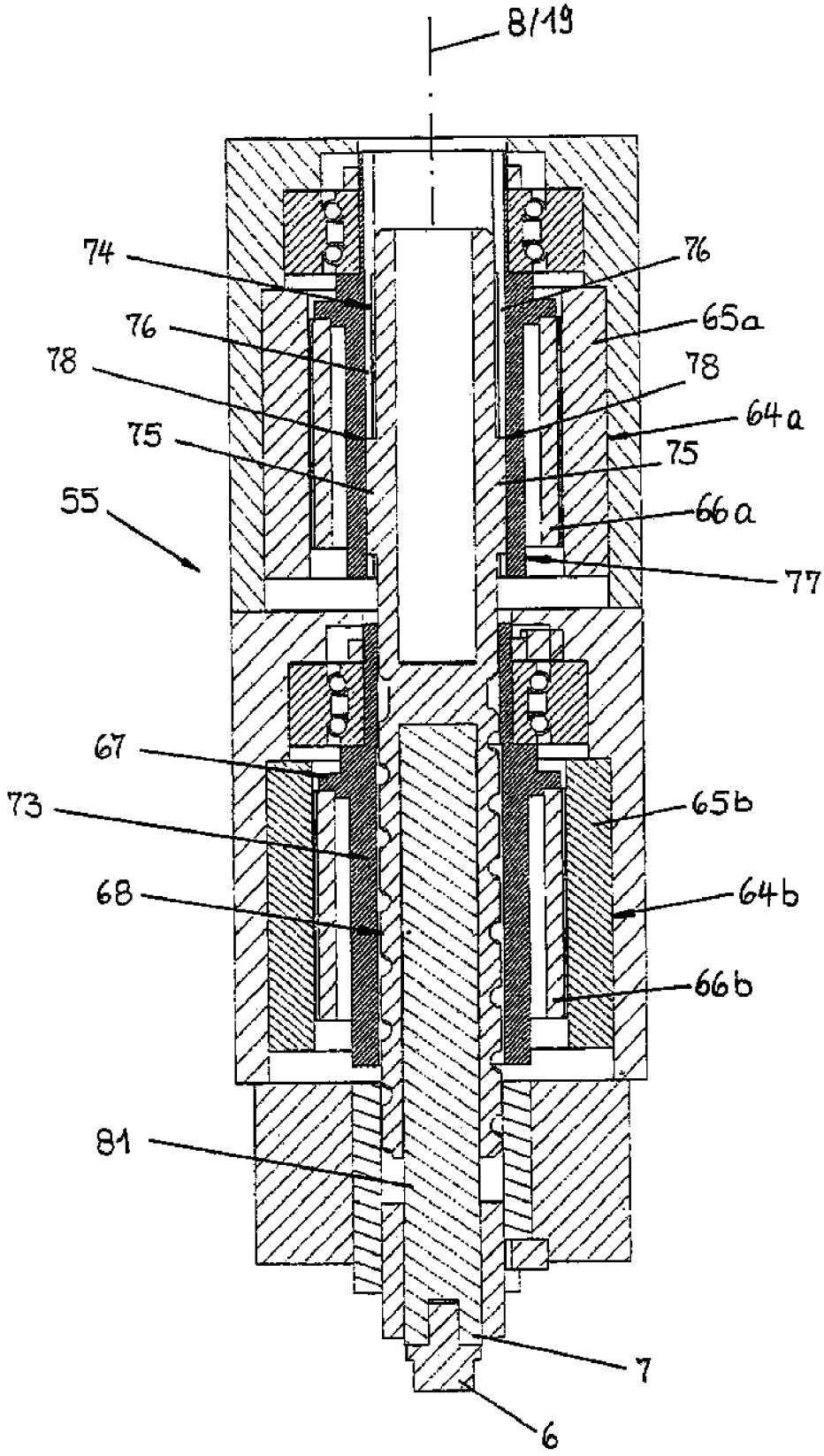
FIG. 6 shows another embodiment of the electric rotary/lifting drive for a punch upper die.

FIG. 6 illustrates another embodiment having an electric rotary/lifting drive 55 with two separate drive motors. The electric rotary/lifting drive 55 can be used on the punching machine 1 in place of the electric rotary/lifting drive 5. The electric rotary/lifting drive 55 comprises a rotary drive motor 64*a* and a lifting drive motor 64*b*. In one embodiment, both motors may be torque motors. The rotary drive motor 64*a* has a stator 65*a* and a rotor 66*a*, which is directly connected to a driving element 77. During operation, the rotary drive motor 64*a* rotates jointly with the driving element 77 about the lifting axis 8 of the rotary/lifting drive 55.

The driving element 77 supports an axial extension 74 that may be formed in one piece with a drive spindle 68. Unlike the axial extension 24 according to FIGS. 2 to 5, in one embodiment, the axial extension 74 includes a hollow cylinder. The axial extension 74 may engage with radial fins 75 in axial guide grooves 76 on the driving element 77. Together, the radial fins 75 on the axial extension 74 and the axial guide grooves 76 on the driving element 77 form an axial guide 78 for the axial extension 74 and the drive spindle 68 formed in one piece therewith.

A lifting spindle nut 67 is located on the drive spindle 68. The lifting spindle nut 67 is rotatable about the lifting axis 8 and (may be mounted) in the direction of the lifting axis. In one embodiment, the lifting spindle nut 67 is connected to a rotor 66*b* of the lifting drive motor 64*b* without interposed gearing. Associated with the rotor 66*b* is a stator 65*b* of the lifting drive motor 64*b*. A spindle axis 19 of the drive spindle 68 coincides with the lifting axis 8. Unlike the drive spindle 18 according to FIGS. 2 to 5, the drive spindle 68 may take the form of a hollow spindle.

The tool bearing 7 with the punch 6 may also be arranged on a ram 81, which is fixed in the axial seat of the drive spindle 68. The lifting spindle nut 67 and the drive spindle 68 form a spindle transmission 73, which like the spindle transmission 23 (FIGS. 2 to 5), may be in the form of a ball screw transmission. In the direction of the lifting axis 8 and in the direction of the spindle axis 19 respectively, the lifting spindle nut 67 and the stator 65*b* of the lifting drive motor 64*b* are arranged mutually overlapping. Furthermore, the driving element 77 and the stator 65*a* of the rotary drive motor 64*a* may also be overlapping.

For punching workpieces, the lifting drive motor 64*b* may be operated. The lifting spindle nut 67 rotating jointly with the rotor 66*b* of the lifting drive motor 64*b* drives the drive spindle 68 in the direction of the lifting axis 8. Depending on the direction of rotation of the lifting spindle nut 67, the drive spindle 68 (and with it the tool bearing 7 plus the punch 6) is lowered towards the workpiece to be machined or is retracted with respect to the machined workpiece. The rotary drive motor 64*a* is off during punching operation of the electric rotary/lifting drive 55. When the rotary drive motor 64*a* is off, the rotor 66*a* is blocked in the direction of rotation from rotation about the lifting axis 8. The same applies to the driving element 77, which is supported with positive locking on the rotor 66*a*. The off-state rotary drive motor 64*a* jointly with the driving element 77 prevents rotation of the drive spindle 68 moving in the axial direction.

To change the rotary adjustment of the tool bearing 7 and of the punch 6 relative to the lifting axis 8, the rotary drive motor

64*a* and the lifting drive motor 64*b* are operated in the same direction of rotation and at the same speed of rotation. The rotor 66*a* of the rotary drive motor 64*a* in the process entrains the axial extension 74, and by way of this the drive spindle 68, and the lifting drive motor 64*b* entrains the lifting spindle nut 67 in the relevant direction of rotation through the desired angle of rotation. In this manner, the rotary adjustment of the tool bearing 7 and the punch 6 is changed, without a relative rotary movement of lifting spindle nut 67 and drive spindle 68 and, thus, an associated axial displacement of the drive spindle 68.

The functions of the electric rotary/lifting drive 55 may also be numerically controlled. Components of the numeric control include, amongst other things, sensors (not shown nor explained in detail) for detecting speed of rotation, rotated angle, and direction of rotation of the lifting spindle nut 67 and the drive spindle 68.

Figure 7:
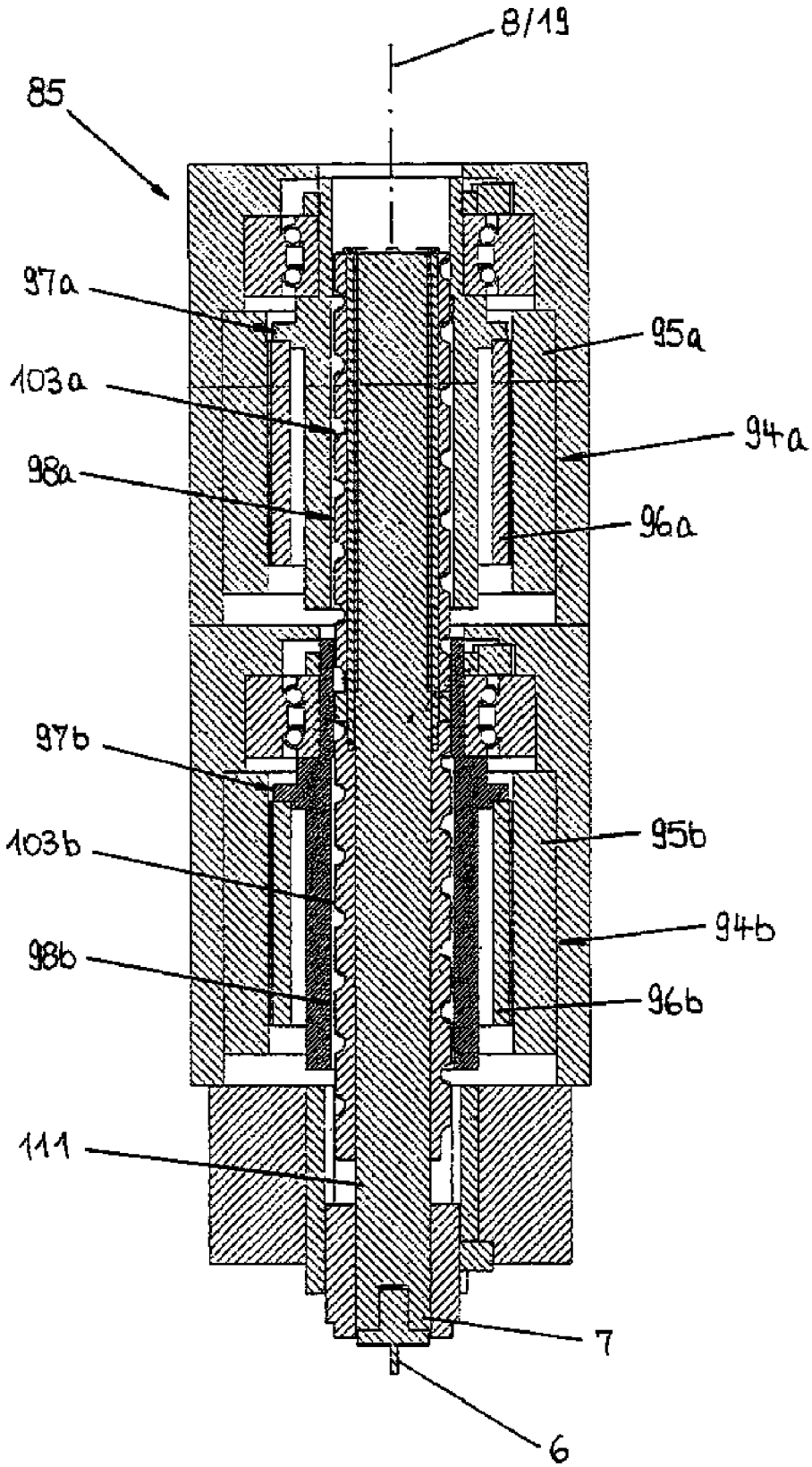
FIG. 7 shows yet another embodiment of an electric rotary/lifting drive for a punch upper die of a punching machine.

FIG. 7 shows yet another embodiment of an electric rotary/lifting drive 85 with drive motors 94*a*, 94*b* in the form of torque motors. The drive motor 94*a* has a stator 95*a* and a rotor 96*a*; the drive motor 94*b* has a stator 95*b* and a rotor 96*b*. The rotor 96*a* is directly connected to a threaded lifting spindle nut 97*a*; the rotor 96*b* is directly connected to a threaded lifting spindle nut 97*b*. The lifting spindle nut 97*a* sits on a drive spindle 98*a*; the lifting spindle nut 97*b* sits on a drive spindle 98*b*. The lifting spindle nuts 97*a*, 97*b* and the associated motors 95*a*, 95*b* of the drive motors 94*a*, 94*b* are arranged mutually axially overlapping.

Both drive spindles 98*a*, 98*b* may be in the form of hollow spindles. On their inside, the drive spindles 98*a*, 98*b* receive a ram 111, at the workpiece-side end of which the tool bearing 7 with the punch 6 is provided. The drive spindles 98*a*, 98*b* are connected to the ram 111 to form a single structural unit. The lifting axis 8 of the rotary/lifting drive 85 coincides with a common spindle axis 19 of the drive spindles 98*a*, 98*b*. Together with the drive spindle 98*a*, the lifting spindle nut 97*a* may form a spindle transmission 103*a*, and together with the drive spindle 98*b*, the lifting spindle nut 97*b* may form a spindle transmission 103*b*. In one embodiment, the spindle transmissions 103*a*, 103*b* have oppositely directed threads, but are otherwise of identical construction.

For punching workpieces, the two drive motors 94*a*, 94*b* are operated at the same speed but in opposite directions. As a result, the drive spindles 98*a*, 98*b* and the tool bearing 7 and the punch 6 are displaced in the direction of the lifting axis 8. By virtue of the oppositely directed motor drive, the lifting spindle nut 97*a* and the drive motor 94*a* prevent rotation of the drive spindle 98*b*. The lifting spindle nut 97*b* and the drive motor 94*b* prevent rotation for the drive spindle 98*a*.

For rotary adjustment of the tool bearing 7 and the punch 6 about the lifting axis 8 and the spindle axis 19 respectively, the drive motors 94*a*, 94*b* are operated at corresponding speed and with identical direction of rotation. This results in a joint rotary movement of the lifting spindle nut 97*a* and the drive spindle 98*a* and of the lifting spindle nut 97*b* and the drive spindle 98*b*. There is little or no relative rotary movement between the lifting spindle nut 97*a* and the drive spindle 98*a* or between the lifting spindle nut 97*b* and the drive spindle 98*b*. In this state, the lifting spindle nuts 97*a*, 97*b* act as driving elements for the drive spindles 98*a*, 98*b*. As such, depending on the mode of operation, the drive motors 94*a*, 94*b* may form rotary drive motors or lifting drive motors. Additionally, an axial displacement of the drive spindles 98*a*, 98*b* and of the tool bearing 7 with the punch 6 with simultaneous change in the rotated position relative to the lifting axis 8 is also possible. For example, in one embodiment, this effect may be achieved by operating the drive motors 94*a*, 94*b* at different speeds.

Additional description of one or more of the features described above may be provided in commonly assigned U.S. patent application Ser. No. 11/563,613 entitled SPINDLE DRIVE SUPPORT, filed Nov. 27, 2006 (Our Ref.: 15540-100001), and/or commonly assigned U.S. patent application Ser. No. 11/563,528, entitled COUNTER ROTATING SPINDLE TRANSMISSION, filed Nov. 27, 2006 (Our Ref.: 15540-101001). Both of these applications are hereby incorporated by reference.

A number of embodiments of the invention have been described. Nevertheless, it will be understood that various modifications may be made without departing from the spirit and scope of the invention. For example, in other embodiments other suitable motors or transmission types may be employed. Accordingly, other embodiments are within the scope of the following claims

What is claimed is:

1. A punching machine comprising:

a tool bearing;

a drive spindle coupled to the tool bearing;

a threaded spindle nut sitting on the drive spindle and forming a spindle transmission together with the drive spindle; and a drive system configured to move the tool bearing axially along a lifting axis and to rotate the tool bearing about the lifting axis, the drive system comprising:

a motor system comprising a stator and a rotor internally coupled to the stator; and the rotor coupled to the spindle nut, wherein the spindle nut cooperates with the drive spindle and wherein the spindle nut is at least partially disposed within the stator.

2. The punching machine of claim 1, wherein the drive system comprises a driving element that is coupleable to the motor system, wherein the driving element is configured to prevent axial movement of the tool bearing along the lifting axis when the driving element is coupled to the motor system.

3. The punching machine of claim 2, comprising an anti-rotation slide, wherein the anti-rotation slide is configured to prevent rotation about the lifting axis when the driving element is not coupled to the motor system.

4. The punching machine of claim 2, wherein the spindle nut and the driving element are arrayed side-by-side along the lifting axis.

5. The punching machine of claim 1, wherein the punching system comprises a switch system, wherein the switch system is configured to couple the motor system and the spindle nut together.

6. The punching machine of claim 5, wherein the switch system comprises a coupling slide that is displaceable along the lifting axis.

7. The punching machine of claim 5, wherein the coupling slide is configured to take a first displaced position that releases the driving element from a driving element abutment to enable rotation of the tool bearing about the lifting axis and connects the driving element and the spindle nut with one another in a manner to rationally secure the spindle nut.

8. The punching machine of claim 5, wherein the coupling slide is configured to take a second displaced position that releases the rotationally secure connection of the spindle nut and fixes the driving element at a driving element abutment to prevent rotation of the tool bearing about the lifting axis.

9. The punching machine of claim 1, wherein the motor system comprises:

a lifting drive coupled to the drive spindle and comprising the stator and the rotor; and a rotary drive coupled to the drive spindle and comprising another stator and another rotor internally coupled to the another stator, wherein the rotary drive comprises a driving element at least partially disposed within the another stator.

10. The punching machine of claim 1, wherein the motor system comprises a torque motor.

11. The punching machine of claim 1, wherein the lifting axis coincides with a spindle axis of the drive spindle.

12. The punching machine of claim 1, wherein the spindle nut is directly coupled to the rotor of the motor system.

13. The punching machine of claim 1, wherein the drive system further comprises:

a second motor system and a second spindle nut cooperating with a second drive spindle, coaxially arranged with the first drive spindle.

14. The punching machine of claim 13, wherein a common spindle axis of the first and second drive spindles coincides with the lifting axis.

15. The punching machine of claim 13, wherein the first spindle nut and the first drive spindle form a first spindle transmission, and wherein the second spindle nut and the second drive spindle form a second spindle transmission, and wherein the first and second spindle transmissions are of identical construction, but have oppositely threads.

* * * * *